343-909
8/21/84 XR 4,467,329

United States Patent [19]
Thal, Jr.

[11] Patent Number: 4,467,329
[45] Date of Patent: Aug. 21, 1984

[54] LOADED WAVEGUIDE LENSES

[75] Inventor: Herbert L. Thal, Jr., Wayne, Pa.

[73] Assignee: General Electric Company, Philadelphia, Pa.

[21] Appl. No.: 267,436

[22] Filed: May 27, 1981

[51] Int. Cl.[3] ..... H01Q 15/06
[52] U.S. Cl. ..... 343/753; 343/909
[58] Field of Search ..... 343/909, 910, 911 R, 343/753, 754, 755, 756

[56] References Cited

U.S. PATENT DOCUMENTS

| | | | |
|---|---|---|---|
| 2,833,909 | 9/1974 | Schaufelberger | 343/754 |
| 2,834,962 | 5/1958 | Proctor | 343/909 |
| 4,044,360 | 8/1977 | Wolfson et al. | 343/754 |
| 4,194,209 | 3/1980 | Coulbourn, Jr. | 343/753 |
| 4,321,604 | 3/1982 | Ajioka | 343/753 |

*Primary Examiner*—Eli Lieberman
*Attorney, Agent, or Firm*—Allen E. Amgott

[57] ABSTRACT

Waveguide lenses characterized by wide bandwidth, polarization-insensitivity, and absence of physical zoning steps. A waveguide lens constructed in accordance with the variable cut-off frequency approach of the invention comprises a two-dimensional array of individual waveguide elements arranged in proximate juxtaposition extending between inner and outer lens surface contours. At least a portion of the outer surface contour follows a constant group delay surface contour, and the individual waveguide elements are configured so as to have cut-off frequencies individually selected so as to compensate the phase lengths of individual waveguide elements to provide constant phase delay. For determining the various cut-off frequencies and thus phase lengths, the individual waveguide elements may have various cross-sectional configurations, various fillings of dielectric material, or both. Preferably, the portion of the outer surface contour following a constant group delay surface contour includes an annular region in the vicinity of 0.6 times lens radius for typical illumination-taperings and the radially-central region follows a constant phase delay surface contour. A waveguide lens in accordance with the filter-type approach of the invention comprises a two-dimensional array of individual waveguide elements arranged in proximate juxtaposition extending between inner and outer lens surfaces. Filter structures are provided in selected individual waveguide elements, with the parameters of the individual filter structures selected so as to achieve both minimum group delay distortion and minimum phase delay distortion.

18 Claims, 22 Drawing Figures

LOADED WAVEGUIDE LENSES

BACKGROUND OF THE INVENTION

The present invention relates generally to waveguide lenses and, more particularly, to waveguide lenses characterized by wide bandwidth and polarization insensitivity.

Waveguide lenses are used to focus electromagnetic energy to or from a feed, or a cluster of feeds. Such a lens generally comprises an assemblage of short waveguide elements positioned side by side in a two-dimensional array, with the combined inner and outer surfaces shaped generally (but not necessarily) to a lens contour, although in a zoned waveguide lens there may be physical step discontinuities between zones. Several varieties of waveguide lenses exist. The zoned variety of waveguide lens is made of hollow waveguides, and its outer surface is stepped in concentric rings of appropriate radii. Other varieties employ various forms of phase shifters in the waveguide elements to produce the phase correction required for focussing.

The design of such lenses where wide bandwidth is desired involved a number of dilemmas, discussed in detail hereinafter. As brief examples of such dilemmas, the constant group delay lens contour surfaces and the constant phase delay lens contour surfaces do not coincide. Physical zoning steps of some designs introduce polarization-sensitive variations, serious phase rotations, and shadowing.

By way of example; the following U.S. patents are identified as disclosing various known forms of waveguide lenses: Kock U.S. Pat. No. 2,562,277; Kock U.S. Pat. No. 2,576,463; Kock U.S. Pat. No. 2,596,251; Kock U.S. Pat. No. 2,599,763; Kock U.S. Pat. No. 2,603,749; Affel, Jr. U.S. Pat. No. 2,607,009; Kock U.S. Pat. No. 2,640,154; Kock U.S. Pat. No. 2,712,067; Crawford U.S. Pat. No. 2,729,816; Kock U.S. Pat. No. 2,733,438; Rust et al U.S. Pat. No. 2,764,757; Kock U.S. Pat. No. 2,769,171; Proctor, Jr. U.S. Pat. No. 2,834,962; Young, Jr. U.S. Pat. No. 2,841,793; Berkowitz U.S. Pat. No. 3,049,708; Dion U.S. Pat. No. 4,156,878; and Coulbourn, Jr. U.S. Pat. No. 4,194,209. Further examples are disclosed in the literature, such as Dion and Ricardi, "A Variable-Coverage Satellite Antenna System," *Proc. IEEE,* Feb. 1971, pp. 252–262.

Somewhat related to waveguide lenses are dielectric lenses, representative examples of which are disclosed in the following U.S. Patents: McMillian U.S. Pat. No. 2,985,880; Cary et al U.S. Pat. No. 3,886,558; and Beyer U.S. Pat. No. 3,886,561. Other related lenses are disclosed in Cohn U.S. Pat. No. 2,617,936 and Kock U.S. Pat. No. 2,747,184.

As discussed in detail hereinafter, an important characteristic of waveguide lenses in accordance with the invention is wide bandwidth without physical zoning steps, and without sensitivity to polarization. Accordingly, it is relevant to consider specifically several of the patents identified above which employ zoning techniques to achieve a wider bandwidth, but avoid physical zoning steps.

As one specific example, the disclosure of the Proctor, Jr. U.S. Pat. No. 2,834,962 points out that physical zoning steps can be avoided by providing a variable refractive index lens wherein different waveguides of the lens have different refractive indices at a particular frequency. Proctor, Jr. further discloses the provision of two separately-proportioned, differently-loaded regions in each waveguide having different phase velocities and different refractive indices. Proctor, Jr. describes the use of ridging along on in conjunction with a dielectric material for varying the cut-off frequency of the waveguide channels. However, all of the approaches which Proctor, Jr. illustrates are suitable only for a single linear polarization, and not for orthogonal linear polarizations (and hence, not for circular polarization). Furthermore, they involve two distinct sections (focussing and compensating), or sometimes three along the waveguide axis, where the length of each section may vary as a function of its transverse location.

As another specific example, the Dion U.S. Pat. No. 4,156,878 discloses smooth lens contour surfaces between which there are separate delay and phase compensating sections. The Dion lens is zoned in the sense that it employs pins, the rotational angle of which should periodically return to the starting point as radius increases. Due to the nature of the phase shifting mechanism, the Dion lens is fundamentally limited to a single (generally circular) polarization (e.g., right circular but not left). Thus, it is not suitable for polarization diversity. (It is believed to actually reverse the rotation of a circularly polarized wave passing through.) Further, the Dion lens appears restricted as a practical matter to the use of circular waveguides in order to allow mechanical rotation of the phase shifters.

By the present invention there are provided relatively thin waveguide lenses characterized by wide bandwidth, improved phase length match for all ray paths through the lens across the lens without physical zoning steps, and polarization insensitivity.

SUMMARY OF THE INVENTION

Briefly, in accordance with one overall concept of the invention, it is recognized that advantage may be taken of a particular property of electromagnetic waveguides, namely, that phase velocity within a waveguide is a function of cut-off frequency. A waveguide can readily be designed to have a particular cut-off frequency. Thus, to achieve desired group delay and desired phase delay simultaneously, in accordance with the invention, group delay for a particular radial location in the lens is controlled through initial selection of the length of a particular waveguide element, and then whatever phase delay compensation is required for that particular lens radial location is controlled by selecting cut-off frequency.

More particularly then, in accordance with a specific aspect of the invention, herein termed the variable cut-off frequency approach, a waveguide lens comprises a two-dimensional array of individual waveguide elements arranged in proximate juxtaposition extending between inner and outer lens surface contours. At least a portion of the outer surface contour follows a constant group delay surface contour, and the individual waveguide elements are configured so as to compensate the phase lengths of individual waveguide elements to provide constant phase delay. For determining the various cut-off frequencies and thus phase lengths, the individual waveguide elements may have various cross-sectional configurations, various fillings of dielectric material, or both.

Preferably, the portion of the outer surface contour following a constant group delay surface contour includes an annular region in the vicinity of 0.6 times the lens radius, and the radially-central region follows a constant phase delay surface contour.

Briefly, in accordance with another overall concept of the invention, it is recognized that, as a result of the properties of waveguide bandpass filter-type structures (which involve impedance discontinuities), it is possible to achieve independent design control over group velocity and phase velocity.

In accordance then with another more particular aspect of the invention, herein termed the filter-type approach, a waveguide lens comprises a two-dimensional array of individual waveguide elements arranged in proximate juxtaposition extending between inner and outer lens surfaces. Filter structures are provided in selected individual waveguide elements, with the parameters of the individual filter structures selected so as to achieve both minimum group delay distortion and minimum phase delay distortion.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DESCRIPTION OF THE PREFERRED EMBODIMENTS

It is believed that the concepts and principles of the present invention will be better understood if preceded by a general summary of bandwidth problems in waveguide lenses. Accordingly, a general summary is presented next, below, followed by a detailed description of two separate approaches in accordance with the invention. Various relevant equations are provided in the general summary which immediately follows, and several of these equations are referred to again in the subsequent detailed description.

It will be appreciated that design of a waveguide lens is predicated upon design equations which, to those skilled in the art, sufficiently describe the required parameters of the actual physical embodiments. Accordingly, an equation approach is employed herein as providing the most meaningful information to those skilled in the art.

GENERAL DESIGN OF WAVEGUIDE LENSES

Figure 1A:
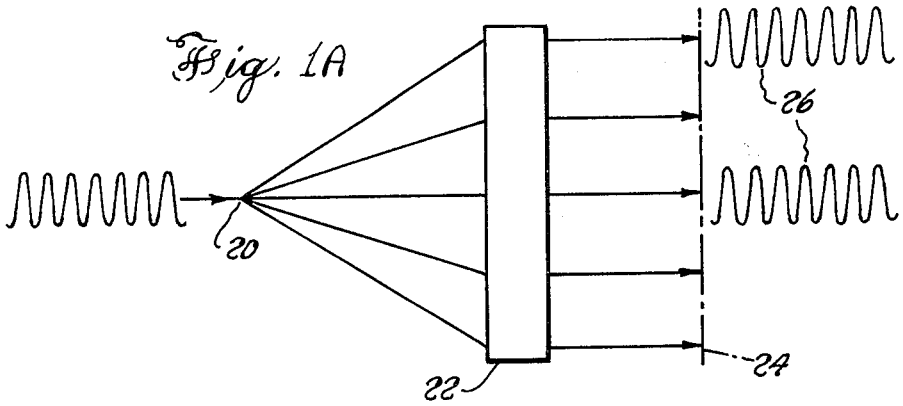
FIG. 1A is a model of a waveguide lens focussing mechanism for a sinusoidal wave.
Figure 1B:
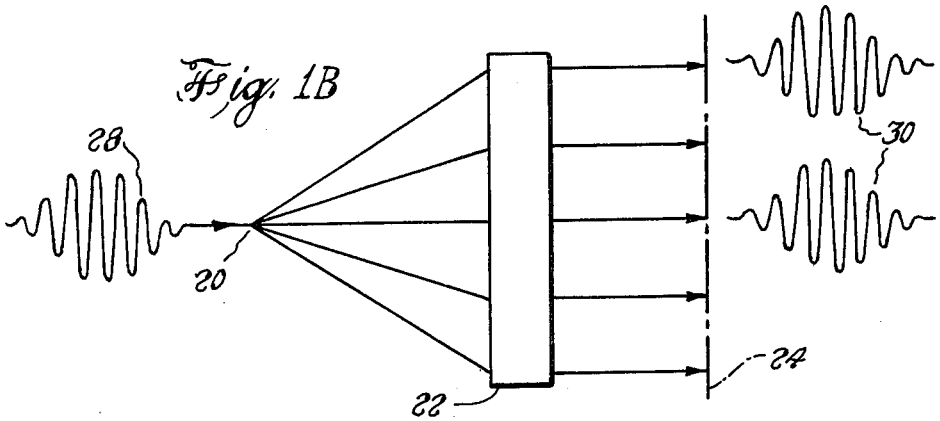
FIG. 1B is a model of a waveguide lens focussing mechanism for pulses.

Referring first to FIGS. 1A and 1B, there is shown a simple model of the waveguide lens focussing mechanism. This model comprises a source at the focus 20, an arbitrary lens 22, and a reference plane 24 perpendicular to the axis of the lens 22. As shown in FIG. 1A, for the single-frequency (or narrowband) case it is sufficient that the sinusoidal wave trains 26 corresponding to various paths through the lens be in phase at the reference plane 24. But if the lens is to be broadband, as shown in FIG. 1B, this condition must be satisfied at all frequencies in the band so that the envelope of a pulse 28 comprising frequency components within the band and launched from the focus 20 arrives at the reference plane 24 as pulses 30 at the same time, regardless of the path taken.

In addition to the focussing model of FIGS. 1A and 1B, there are a number of relationships and properties of guided waves which are relevant, and which are expressed in the following equations. These properties are very general and depend only on the fact that the waveguide be uniformly filled with a dielectric (e.g., air or vacuum), and that its cross section (e.g., square, circular or ridged) does not vary along the direction of propagation.

The phase shift per unit length of a wave traveling in the waveguide is:

$$\beta = \beta_o\sqrt{1-\left(\frac{f_c}{f}\right)^2} \tag{1}$$

where $\beta_o$ is the free space value which equals $\omega/c$ or $2\pi/\lambda_o$ (c is the velocity of light through the dielectric filling), f is the operating frequency, and $f_c$ is the cut-off frequency which is a function of the mode, dielectric and waveguide cross section.

The phase shift for a length 1 is thus:

$$\phi=\beta 1 \tag{2}$$

Alternatively the phase velocity $v_p$ (the velocity at which a wave crest appears to move) is given relative to the velocity of light c outside of the waveguide by:

$$\frac{v_p}{c} = \frac{1}{\sqrt{1-\left(\frac{f_c}{f}\right)^2}} = \frac{\beta_o}{\beta} \tag{3}$$

Since the operating frequency f is greater than the cut-off frequency $f_c$, the phase velocity $v_p$ exceeds the velocity of light c in free space.

On the other hand, the envelope of a pulse travels at the group velocity which is given by:

$$\frac{v_g}{c} = \sqrt{1 - \left(\frac{f_c}{f}\right)^2} \tag{4}$$

The group velocity $v_g$ is always less than the free space velocity of light. Then, $$\left(\frac{v_p}{c}\right)\left(\frac{v_g}{c}\right) = 1 \tag{5}$$

so that increasing the phase velocity $v_p$ (by moving the operating frequency f closer to cut-off $f_c$) decreases the group velocity $v_g$.

If the waveguide of physical length t is assumed, from Equations (2), (3) and (5) it can be seen that the phase shift for this waveguide is equivalent to a free space length, $l_p$, which is given by $$l_p = \frac{t}{v_p/c} = t\,[v_g/c] \tag{6}$$

and is always less than the physical length t. If the free space length is removed, the resultant represents an effective change (shortening) of the phase length due to replacement of the free space path with a waveguide. That is, $$l_p - t \equiv d_p = t\,[v_g/c - 1] \tag{7}$$

Because a sinusoidal wave can be shifted by a period without any change in appearance, the definition of differential phase length is not unique. The complete family is given by:

$$d_{pn} = d_p + n\lambda_o \tag{8}$$

where n is any positive or negative integer.

In a similar manner, a differential group length $d_g$ may be defined as $$d_g = \frac{t}{v_g/c} - t = t\left[\frac{1 - v_g/c}{v_g/c}\right] \tag{9}$$

That is, replacement of a free space path by waveguide is the same as increasing the free space path length by $d_g$ as far as group delay is concerned. Because the envelope is not periodic, there is no group delay equation analogous to Equation (8).

The manner in which the preceding equations relate to the properties of waveguide lenses may be illustrated by an assumed example of a waveguide lens having a spherical inner surface of radius $R_i$. The path length relative to a ray through the center of the lens is related to the radial location at which the ray enters the lens by $$l(r) = R_i - \sqrt{R_i^2 - r^2} \tag{10}$$

The phase shift may be compensated by inserting a waveguide section having a differential phase length (negative) from Equation (7), which cancels the increased path length. That is, $$d_p + l(r) = 0 \tag{11}$$

$$t_p = \frac{-l(r)}{v_g/c - 1} = \frac{l(r)}{1 - v_g/c} \tag{12}$$

If Equation (7) is generalized by Equation (8), the entire family of possible lengths becomes:

$$t_p = \frac{l(r) + n\lambda_o}{(1 - v_g/c)} + t_{po} \tag{13}$$

where $t_{po}$ is an arbitrary fixed length which may be added to all waveguides without altering the relative phase performance.

Figure 2:
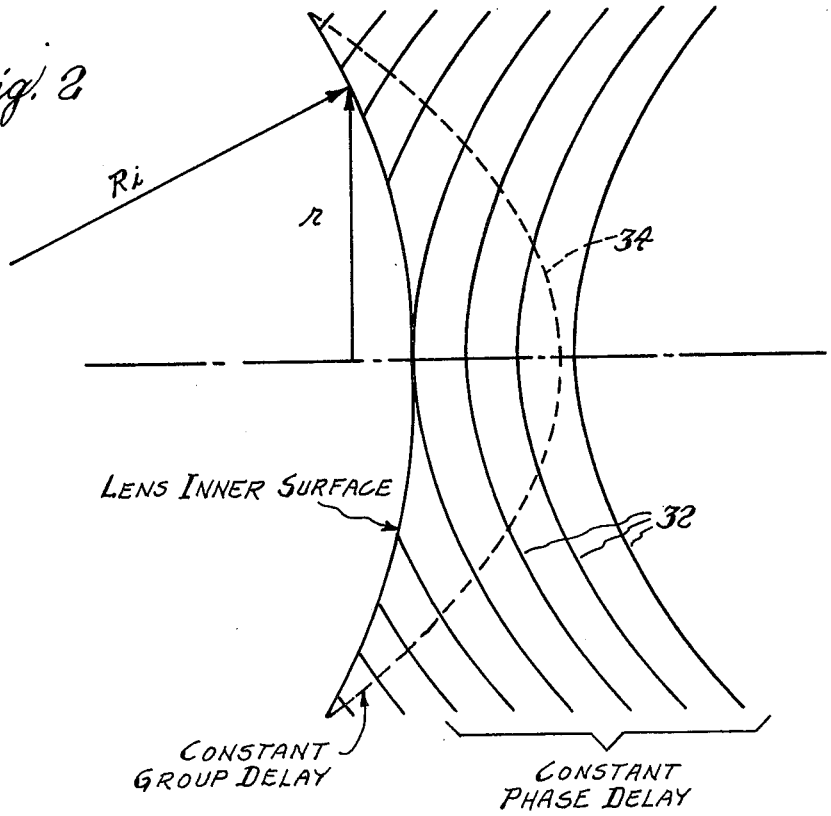
FIG. 2 is a representation of a constant group delay surface contour and a plurality of constant phase delay surface contours for waveguide lenses.

With reference now to FIG. 2, the contours expressed in Equation (13) of possible lens thicknesses for phase compensation are shown as "constant phase delay" surfaces or contours 32. As illustrated in FIG. 2, the constant phase delay surfaces 32 are thin in the lens center, and thick at the rim.

In addition to the lens contour or thicknesses for constant phase delay, there are contours or lens thicknesses for constant group delay. The lens thickness which yields a constant group delay can be derived from Equation (9) to yield the following:

$$t_g = \frac{-l(r)(v_g/c)}{(1 - v_g/c)} + t_{go} \tag{14}$$

It is significant to note that the sign of the radially-dependent term of Equation (14) for constant group delay surfaces is opposite that of Equation (13) for constant phase delay surfaces. Also, in Equation (14) the radially-dependent term is multiplied by the factor $v_g/c$.

FIG. 2 illustrates only one constant group delay surface 34, the one for minimum lens thickness. Minimum thickness occurs when $t_g$ goes to zero at the rim (r=a). In this case:

$$t_{go} = \frac{l(a)(v_g/c)}{(1 - v_g/c)} \tag{15}$$

Contrasting Equations (13) and (14), as reflected in FIG. 2 depicting the opposite curvatures of the constant phase delay surfaces 32 and the exemplary constant group delay surface 34, the bandwidth dilemma of waveguide lenses is dramatized. The thicker rim of the constant phase delay surfaces 32 increases the velocity of the rays, allowing them to catch up with the shorter-path rays through the center. However, a phase velocity greater than the velocity of light is a sort of sleight-of-hand which loses significance when a broadband signal is involved. The constant group delay surface 34 is thicker in the middle, thereby retarding the envelope in this region relative to the longer path rays which are retarded less. This is the more fundamental approach since it is theoretically possible to have the phase and group velocities equal to one another if both are less than the velocity of light; unfortunately an unloaded piece of waveguide does not satisfy this condition by virtue of Equation (5).

With the foregoing as background, several specific forms of prior art waveguide lenses will now be mentioned, and then contrasted to those of the subject invention.

Preliminarily, it should be noted that the specific lenses described herein are for convenience depicted only as inner and outer surfaces, contoured or stepped, as the case may be. It will be appreciated however that all of these lenses comprise a two-dimensional assemblage or array of individual waveguide elements in proximate juxtaposition, with the length of each waveguide element being the distance between the inner and outer lens surfaces. These lengths typically vary as a function of radius, although uniform-thickness lenses are also employed. In the case of a uniform-thickness lens, all of the individual waveguide elements have the same length, differing in some other respect such as diameter, cross-section, or internal loading elements.

Figure 3:
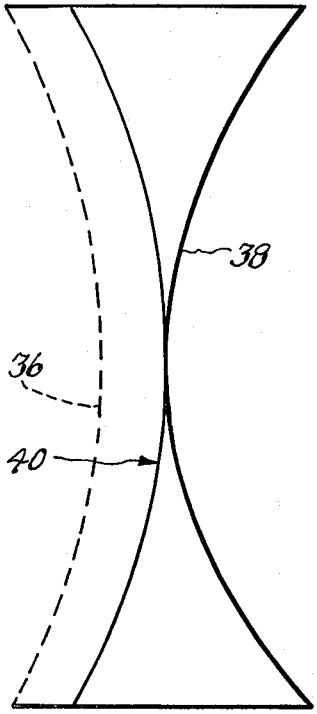
Fig. 3 PRIOR ART
FIG. 3 depicts a simple form of prior art waveguide lens.

As depicted in FIG. 3, a simple form of waveguide lens has an inner surface 36 which typically is a portion of a spherical surface, and an outer surface 38 which follows a constant phase delay surface. The minimum center thickness is set by mechanical considerations, and a constant-thickness "bias" is accordingly provided between the actual inner surface 36 and a theoretically-possible inner surface 40. The inner surface 36 faces the feed point 20 (FIGS. 1A and 1B). The FIG. 3 lens has very limited bandwidth due to the divergent phase and group surfaces (FIG. 2).

Figure 4:
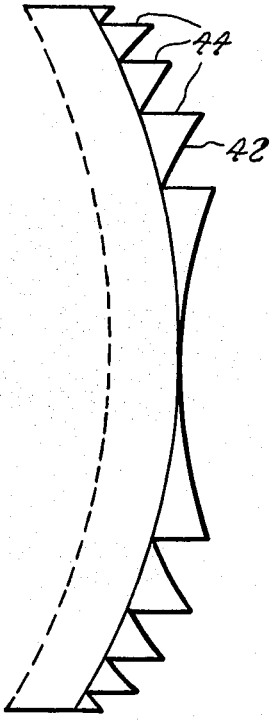
Fig. 4 PRIOR ART
FIG. 4 depicts a prior art waveguide lens physically zoned for minimum weight.

Depicted in FIG. 4 is a variation of FIG. 3 comprising a physically zoned lens in which the outer surface 42 abruptly changes from one phase surface to another in steps 44 in order to maintain minimum thickness. This zoning, although apparently conceived for mechanical reasons, yields a lens surface which approximates a constant group delay surface (FIG. 2) better than an unzoned one. Thus, ray-tracing techniques indicate better bandwidth. However, the abrupt surface changes introduce polarization-sensitive variations in the phase shift and radiation patterns of the nearby waveguides, thereby degrading the lens performance.

Figure 5:
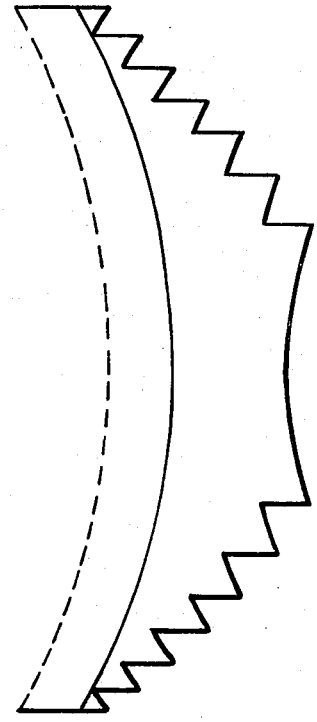
Fig. 5 PRIOR ART
FIG. 5 depicts a prior art physically zoned broadband waveguide lens.

As shown in FIG. 5, the physical zoning concept may be carried a step further by thickening the center of the lens to obtain a surface which oscillates about a constant group delay surface. This approach further improves the apparent phase match across the frequency band, but also increases the number of zones and their attendant aberrations. A similar lens is disclosed in the above-identified Coulbourn, Jr., U.S. Pat. No. 4,194,209.

In FIG. 5, the physical length of the zoning steps may be seen from Equation (13) to be:

$$S = \frac{\lambda_o}{(1 - v_g/c)} \tag{16}$$

This length may be converted into an equivalent free space group length by replacing t in Equation (9) by S; the result is:

$$d_g(\text{zone}) = \frac{\lambda_o}{v_g/c} \tag{17}$$

The equivalent length may in turn be readily converted into a relative phase change as a function of deviation from center frequency by:

$$\Delta\phi = \left[\frac{2\pi\Delta f}{c}\right] d_g = 2\pi\left[\frac{\Delta f}{f_o}\right]\left[\frac{1}{v_g/c}\right] \tag{18}$$

Thus, in the lens of FIG. 5 if it is assumed that the lens surface varies between $\pm S/2$ of the group delay surface (which yields zero phase error), the relative phase error will vary between $\pm\Delta\phi/2$. On the other hand, if some of the zones are removed to obtain the configuration of FIG. 4, an additional error of $\Delta\phi$ will be incurred for each zone deleted. Similarly, the unzoned lens of FIG. 3 will have a (band-edge) phase deviation from center to rim of approximately $\pm N\Delta\phi/2$ where N is the number of zones in the FIG. 5 lens.

AVOIDING PHYSICAL ZONING STEPS

As pointed out hereinabove with reference to FIG. 4, the abrupt surface changes of physical zoning steps 44 introduce polarization-sensitive variations in the phase shift and radiation patterns of the nearby waveguides, thereby degrading the lens performance. The effect of perturbations introduced by physical zoning discontinuities, particularly where polarization insensitivity is desired, deserves careful consideration to avoid false design conclusions. For example, the ray tracing approach may indicate that an additional zoning step improves the patterns. But if this step introduces a 90° phase error for one polarization in the adjacent guide—a not unreasonable estimate based on one model of the solution—there may be little or no net improvement. Accordingly, for these and other reasons, it is believed highly desirable to avoid physical zoning steps.

POWER DISTRIBUTION

In accordance with the invention, advantage is taken of the manner in which power is distributed across a waveguide lens (as a function of radius). Power density may be assumed to vary approximately parabolically across the aperture. That is $$P_d \approx P_o\left[1 - \left(\frac{r}{r_n}\right)^2\right] \tag{19}$$

where $r_n$ is a radius which presumably lies just outside of the rim at which the power density drops to zero according to this approximation.

Taking into account that the circumference and hence the number of waveguides at any radius increases linearly with r, the total power through all of the waveguides at some radius r is proportional to $$P(r)\ \alpha \left(\frac{r}{r_n}\right)\left[1 - \left(\frac{r}{r_n}\right)^2\right] \tag{20}$$

Figure 6:
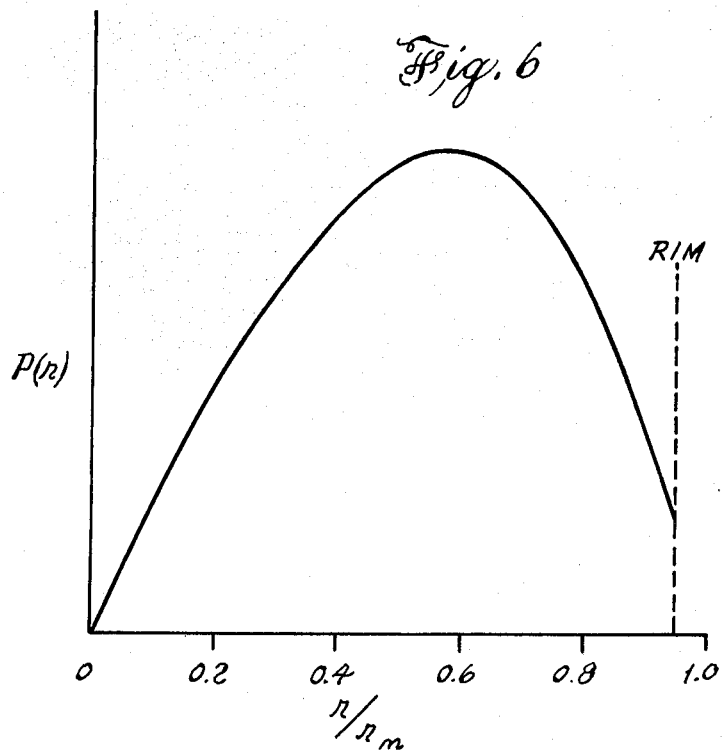
FIG. 6 is a plot of power distribution as a function of lens radius.

With reference to FIG. 6, the curve of Equation (20) is plotted. The maximum value occurs at 0.58 $r_n$. For a 10 db power taper, the rim of the lens corresponds to 0.95 $r_n$.

In accordance with the invention, it is recognized that, as a result of the power distribution depicted in Equation (20) and FIG. 6, it is most important to optimize the lens parameters in the vicinity of 0.6 times the rim radius. The center of the lens is less important because of its small area, and the rim is less important because of the power taper. Due to this reduced sensitivity of the lens center, a larger deviation from the group delay surface may be tolerated. For example, a lens could be designed with the center a full zoning step inside of the group delay surface in order to obtain a larger unzoned central portion and to reduce the physical size. The remainder of the lens is then designed to oscillate about the group delay surface as indicated in FIG. 5.

VARYING WAVEGUIDE CUT-OFF FREQUENCY

An important aspect of the invention is achieving phase control by varying the cut-off frequency of selected waveguides (without physical zoning steps) by techniques such as adding a ridge, loading with dielectric, increasing waveguide size, and rounding the waveguide corners.

The prior art lens of FIG. 5 provides an appropriate starting point for purposes of example. In accordance with the invention, the physical zoning steps of FIG. 5 are eliminated.

Figure 7:
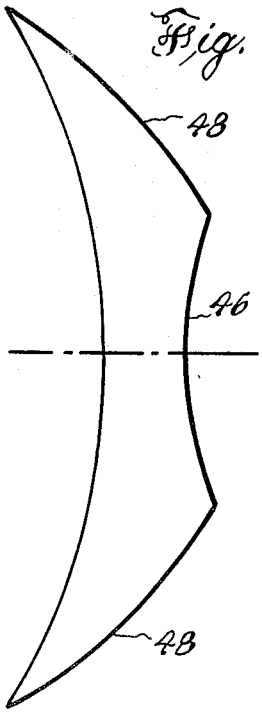
FIG. 7 depicts the cross-section of a lens in accordance with the variable cut-off frequency aspect of the invention.

FIG. 7 illustrates the general cross-section of one form of lens in accordance with the invention, evolved from FIG. 5 as discussed next below.

Initially, in view of the "Power Distribution" considerations discussed hereinabove, it is necessary to optimize primarily in the vicinity of 0.6 times the rim radius. The center configuration of FIG. 5 is accordingly left unchanged to generate the FIG. 7 central region 46.

Next, a smooth outer surface 48 is developed by using one of the longer waveguides in each physical zone of FIG. 5 to establish a contour point. A constant "bias", e.g., one-fifth of a zoning step, may be added to each contour point. Physical waveguide lengths are lengthened or shortened as required to lie on the smooth contour surface 48. Thus the FIG. 7 contour 48 follows a constant group delay surface (as discussed hereinabove with reference to FIG. 2). In contrast, the outer surface of the prior art FIG. 5 lens oscillates about a constant group delay surface.

Lastly, the phase lengths are equalized (phase characteristics corrected) by altering the cut-off frequency in selected waveguides. This is possible because, from equation (1), the phase shift per unit length depends on cut-off frequency.

Presented next below is TABLE I which sets forth specific parameters of such a design (for one cross-section plane) (for a center frequency of 8150 MHz), followed by a more detailed discussion of design procedures.

TABLE I

DESIGN PARAMETERS FOR FIG. 7 LENS

| Radius (inches) | Thickness (inches) | $\Delta\phi$ at Lower Band Edge | Cut-off Frequency (MHz) |
|---|---|---|---|
| 0. | 5.69 | 12° | 6449.7 |
| 0.91 | 5.71 | 12° | 6449.7 |
| 1.83 | 5.79 | 11° | 6449.7 |
| 2.74 | 5.91 | 11° | 6449.7 |
| 3.66 | 6.07 | 10° | 6449.7 |
| 4.57 | 6.29 | 9° | 6449.7 |
| 5.49 | 6.55 | 7° | 6449.7 |
| 6.40 | 6.87 | 5° | 6449.7 |
| 7.32 | 7.23 | 3° | 6449.7 |
| 8.23 | 7.64 | 1° | 6449.7 |
| 9.15 | 8.11 | 0° | 6449.7 |
| 10.06 | 8.43 | −4° | 6503.7 |

TABLE I-continued

DESIGN PARAMETERS FOR FIG. 7 LENS

| Radius (inches) | Thickness (inches) | $\Delta\phi$ at Lower Band Edge | Cut-off Frequency (MHz) |
|---|---|---|---|
| 10.98 | 8.09 | −9° | 6760.7 |
| 11.89 | 7.71 | 5° | 5872.3 |
| 12.81 | 7.30 | 0° | 6259.6 |
| 13.72 | 6.86 | −6° | 6662.7 |
| 14.64 | 6.38 | 6° | 5625.6 |
| 15.55 | 5.86 | 0° | 6236.1 |
| 16.47 | 5.32 | −8° | 6851.2 |
| 17.38 | 4.73 | 3° | 5718.6 |
| 18.30 | 4.11 | −4° | 6680.0 |
| 19.21 | 3.45 | 4° | 5004.4 |
| 20.13 | 2.75 | −3° | 6673.5 |
| 21.04 | 2.01 | 3° | 3497.3 |
| 21.96 | 1.23 | −6° | 7334.0 |

In detail, a generalized design procedure in accordance with the invention is provided by the following five steps:

Step 1. The frequency and aperture dimensions are set as determined by system requirements.

Figure 8:
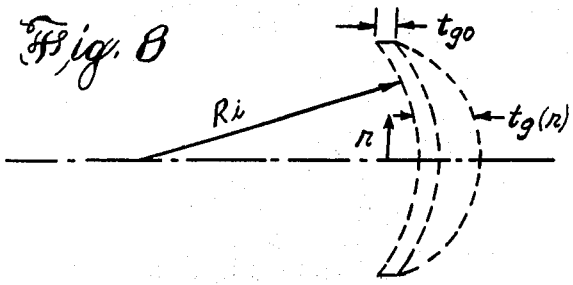
FIG. 8 defines several geometric parameters of a waveguide lens in accordance with the variable cut-off frequency aspect of the invention.

Step 2. Select the following three parameters: $R_i$, for the inner surface; the width of the individual waveguide channels which determines the cut-off frequency, $f_c$; and the thickness of the lens at the rim, $t_{go}$. FIG. 8 depicts the geometry of $R_i$ and $t_{go}$, as well as several other parameters.

Step 3. Determine the group delay thickness (FIG. 2) which should be approximated by the lens thickness by employing Equation (14), plus Equations (10) and (4), where $$f_c = \frac{\text{velocity of light}}{\text{twice the waveguide width}} \tag{21}$$

Step 4. Determine the phase delay thicknesses (FIG. 2) by employing Equation (13). In Equation (13), the arbitrary constant $t_{po}$ locates the constant phase delay surfaces relative to the constant group delay surface.

Step 5. Modify properties of selected waveguide channels to equalize the phase lengths. This step is necessary since the constant group delay surfaces and the constant phase delay surfaces are not the same shape, as discussed in detail hereinabove, and since it is desired to have a smooth lens surface to avoid the drawbacks of physical zoning steps. Specifically, lens thickness is defined as the delay thickness $t_g(r)$, and the phase shift is corrected in one of three ways (I, II and III, below) for those waveguides in which the delay and phase surfaces do not coincide. (For the central region of the lens, the phase surface may be a sufficiently close approximation to the delay surface so that the lens shape of FIG. 7 results.)

Figure 9A:
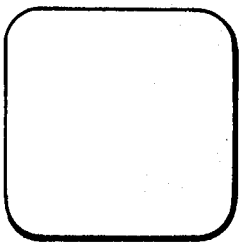
FIGS. 9A and 9B illustrate variations in waveguide cross section for controlling cut-off frequency.
Figure 9B:
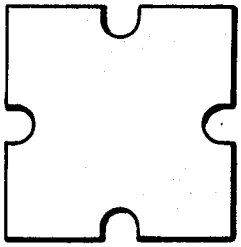

The phase lengths may be modified by the following approaches:

I. Varying the waveguide cross-section to vary $f_c$. E.g., as shown in FIG. 9A, the corners can be rounded to increase $f_c$. Or, as shown in FIG. 9B, ridges can be added to lower $f_c$.

II. Filling the waveguide with a real or artificial dielectric material. Compared to a dielectric lens, these dielectric materials have properties much closer to free space. An exemplary artificial dielectric material is fine metallic whiskers suspended in foam.

III. Both I and II.

Approaches I and II modify the group velocity somewhat in correcting the phase thereby reducing the bandwidth, although this effect can be small with Approach II. With Approach III it is possible to match both phase and group delay.

In the foregoing five steps, the relevant equations are as follows:

The modified cut-off frequency $f_c'$ for Approach I becomes $$f_c' = f\sqrt{1 - \left[1 + \frac{t_p}{t_g}\left(\frac{v_g}{c} - 1\right)\right]^2} \tag{22}$$

where $t_p$ is one of the phase thicknesses, presumably the one which is slightly shorter than the delay thickness or the one just longer.

The required (relative) dielectric constant for Approach II is $$\epsilon = \left(\frac{f_c}{f}\right)^2 + \left[1 + \frac{t_p}{t_g}\left(\frac{v_g}{c} - 1\right)\right]^2 \tag{23}$$

in which case $t_p$ must be chosen to yield an $\epsilon \geqq 1$. Approach III yields less phase error particularly if $$\epsilon = \frac{1 + \frac{t_p}{t_g}\left(\frac{v_g}{c} - 1\right)}{\frac{v_g}{c}} \tag{24}$$

and $$f_c' = f\sqrt{\epsilon - \left[1 + \frac{t_p}{t_g}\left(\frac{v_g}{c} - 1\right)\right]^2} \tag{25}$$

where $f_c'$ is defined as the cut-off frequency of the modified shape but before the waveguide is filled with the dielectric. This approach has extremely low phase errors.

BROADBAND FILTER

Although the "Varying Waveguide Cut-off Frequency" approach of the invention as described above provides an effective waveguide lens without physical zoning steps, there is still a residual phase error due to a lack of independent control over group and phase velocity (except for Approach III). With constant cross-section waveguides of any shape, there is a restrictive relationship between phase and group velocities, as expressed by Equation (5). In the "Varying Cut-off Frequency" approaches described above, it is assumed that the cross section shape and dielectric filling of each waveguide channel is uniform along its entire length (but varies from channel-to-channel dependng on the radial location).

In accordance with another aspect of the invention, herein termed the "filter-type approach", variation of the dielectric filling or waveguide cross-section along selected waveguides is provided. Also, the waveguides may be periodically loaded with obstacles such as inductive irises to form filter circuits.

For reasons discussed hereinabove, in order to optimally achieve wide bandwidth, it is necessary to be able to select independently during design a particular group velocity $v_g$ and a particular phase velocity $v_p$. It is believed that the manner in which such independent control during design is achieved in accordance with the filter-type approach of the invention may be understood with reference to FIGS. 10A and 10B, which depict frequency-phase shift ($\omega/\beta$) diagrams of an unloaded waveguide and a periodically-loaded waveguide, respectively. Contrasting the FIG. 10A and FIG. 10B diagrams illustrates general properties of periodically-loaded waveguides which make them useful in the practice of the invention.

Figure 10A:
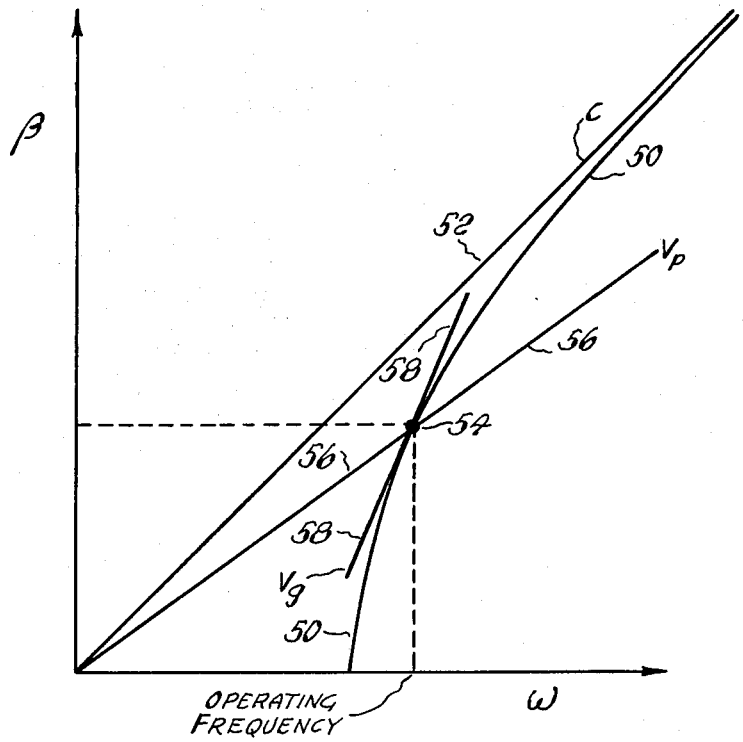
FIG. 10A is a frequency-phase shift diagram of an unloaded waveguide.

With specific reference to FIG. 10A, a typical frequency-phase shift diagram of an unloaded waveguide is illustrated for purposes of comparison. Essentially only a single degree of freedom in design is provided, this being cut-off frequency, $f_c$, for a homogeneous dielectric medium.

In FIG. 10A, the phase-shift-as-a-function-of-frequency characteristic of a particular waveguide is represented by the curved line 50. The characteristic curve 50 approaches the velocity of light, c, represented by a straight line 52 extending from the origin, asymptotically. It will be appreciated that the characteristic curve 50, being for a particular waveguide having a particular lower cut-off frequency only, may be varied by design. Variations will result in changing the starting point of the line 50 along the frequency ($\omega$) axis, but it will always approach the velocity of light c line 52 asymptotically. The limiting case would be for a TEM (coaxial) transmission line, in which case the characteristic curve 50 would coincide with the velocity of light c line 52.

An operating frequency is selected, which then determines an operating point 54 on the characteristic curve 50. The reciprocal of the slope of a line 56 from the origin through the operating point 54 represents phase velocity ($v_p$), as is expressed in Equation (3). The reciprocal of the slope of a line 58 tangent at the operating frequency point 54 represents group velocity ($v_g$), as is expressed in Equation (4). From Equations (3) and (4), both phase velocity ($v_p$) and group velocity ($v_g$) approach the velocity of light (c) asymptotically (but from opposite sides) as operating frequency increases along the characteristic curve 50.

Although only one characteristic curve line 50 (for one particular cut-off frequency) is shown in FIG. 10A, it will be appreciated that an essentially infinite number of others may be drawn. For each of the possible characteristic curves, at a given operating frequency there will be a certain phase velocity $v_p$ and a certain group velocity $v_g$. A wide selection range is therefore available. Nevertheless, since all the possible characteristic curves approach the velocity of light c line 52 asymptotically, completely independent design control over $v_p$ and $v_g$ is not available.

Thus, from FIG. 10A, it can be seen for an air-filled waveguide that a limited degree of design freedom is available, i.e., varying cut-off frequency.

Although not specifically illustrated, a second degree of freedom is available by selecting a dielectric and uniformly filling the waveguide. In FIG. 10A the result would be to rotate the velocity of light c asymptote line 52 about the origin towards the phase shift ($\beta$) axis. This second degree of freedom is useful, but still does not permit completely independent design control over $v_p$ and $v_g$ when all waveguides have the same cross-sectional shape.

Finally, if the waveguides need not be filled with a homogeneous dielectric material, a third degree of freedome is possible. (However, such variations introduce reflections and consequent frequency pass bands and frequency rejects bands. These must be considered, and the operating frequency placed in a pass band.)

Figure 10B:
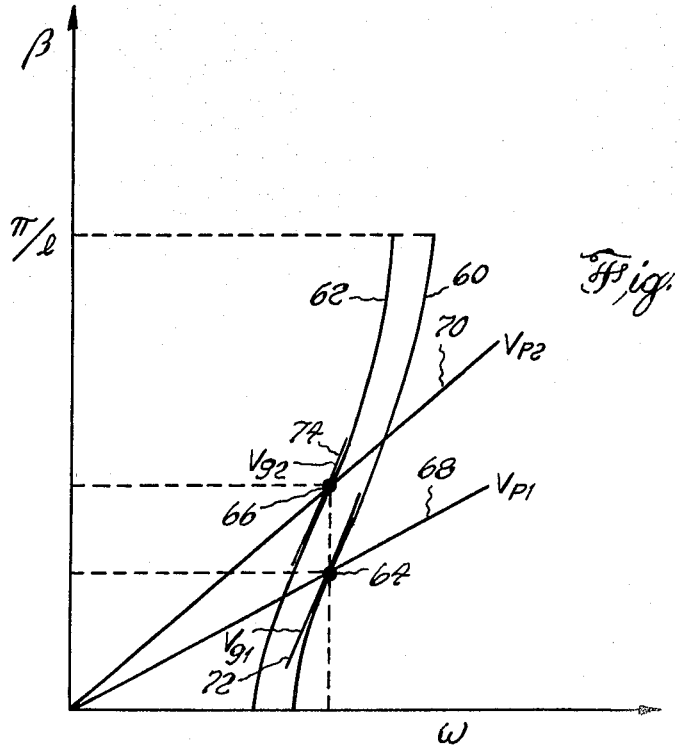
FIG. 10B is a frequency-phase shift diagram of a periodically-loaded waveguide.

With specific reference now to FIG. 10B, a representative frequency-phase shift diagram of a waveguide with periodic loading is shown. FIG. 10B is intended to show that it is possible, through suitable filter design, to have two operating frequency points with the same group velocity $v_g$, but different phase velocity $v_p$'s. This provides sufficient additional design freedom to independently control $v_p$ and $v_g$.

FIG. 10B shows two separate representative characteristic curves 60 and 62 for two different microwave filters placed in two different waveguides in respective different radially-defined locations in a lens. FIG. 10B thus allows comparison of the two filters, and shows that the resultant waveguides (at different lens radial locations) can have the same group velocity $v_g$, but different phase velocities $v_p$'s. (The illustrated curves 60 and 62 are for the first pass bands only, and abruptly terminate when phase shift reaches 180°, at which point a stop band begins.)

More particularly, an operating frequency is selected, defining operating points 64 and 66 on the curves 60 and 62, respectively. As in FIG. 10B, the reciprocals of the slopes of lines 68 and 70 from the origin through the operating points 64 and 66 represent respective velocities $v_{p1}$, and $v_{p2}$. The reciprocals of the slopes of lines 72 and 74 tangent at the operating points 64 and 66 represent respective group velocities $v_{g1}$, and $v_{g2}$. Significantly, through suitable filter design, characteristic curves can in effect be shifted along the frequency axis with little change in curvature at frequencies of interest. Thus, the tangent lines 72 and 74 representing group velocity $v_g$ have nearly the same reciprocal of the slope.

It should also be noted that there is a region along each characteristic curve 60 and 62 within the depicted pass band of relatively constant group velocity $v_g$, the value of which varies essentially directly with the bandwidth or, in other words, with the degree of loading. In summary, varying the operating frequency changes the phase velocity as indicated by $v_{p1}$, and $v_{p2}$. If the operating frequency is fixed, the phase velocity is adjusted by sliding the entire response along the frequency scale. Hence loaded waveguide filter circuits provide the independent control of phase velocity and group velocity required in accordance with the invention.

With the foregoing as background, the design of a filter-type waveguide lens in accordance with the invention will now be described, employing as a starting point a variable cut-off lens, such as is depicted in FIG. 7.

The first step in the transition to the filter-type structure is to vary the thickness of the dielectric filling. For example, in one sample calculation the required dielectric constant varied from 1.0 (i.e. free space of no filling) to a maximum of approximately 1.40.

Figure 11:
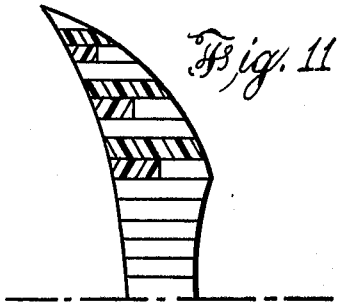
FIG. 11 illustrates individual waveguide elements partially filled with dielectric materials.

FIG. 11, showing the cross-section of half a lens and individual waveguide elements therein, depicts a practical alternative to the problem of fabricating a range of (artificial) dielectric materials to cover this range. In FIG. 11, a material having the maximum dielectric constant value is employed. The waveguides requiring a smaller value are filled over only a fraction of their total lengths. (Some waveguides would have no filling.) The approximate relationship is:

$$(\epsilon-1)t=(\epsilon_e-1)t_e \tag{26}$$

where $\epsilon$ and t are the dielectric constant and thickness required for full length filling, and $\epsilon_e$ and $t_e$ are the (higher) dielectric constant and the length of the filling.

Figure 12A:
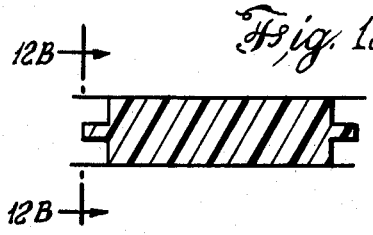
FIGS. 12A, 12B and 13 illustrate techniques for reducing the impedance mismatch at dielectric interfaces.
Figure 12B:
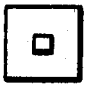
Figure 13:
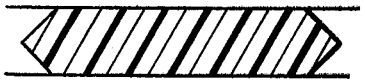

Further, in order to reduce the impedance mismatch at the interfaces, the dielectric material can be stepped, as in FIGS. 12A and 12B, or tapered, as in FIG. 13.

Figure 14A:
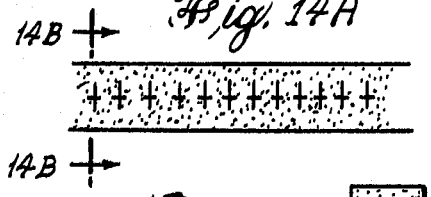
FIGS. 14A, 14B, 15A, 15B and 16 illustrate various forms of artificial dielectric materials.
Figure 14B:
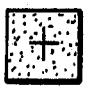
Figure 15A:
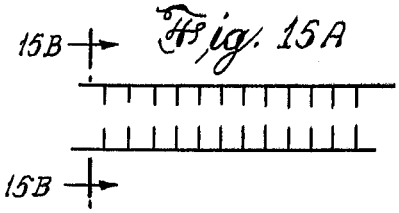
Figure 15B:
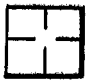
Figure 16:
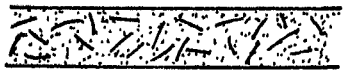

In order to minimize weight, it is preferred that artificial dielectrical materials be employed. These typically consist of metallic whiskers or other shapes suspended in a low density foam or etched on a circuit board, or even attached directly to the waveguide walls. In any case, their spearations are small relative to a wavelength. By way of specific example, FIGS. 14A and 14B illustrate small metallic "plusses" supported in foam. FIGS. 15A and 15B illustrate metallic whiskers attached to the waveguide walls. FIG. 16 illustrates random metallic whiskers supported in foam.

In general, the filter circuits comprise a smaller number of obstacles, each of which has a larger effect. The spacings are of the order of one-quarter to one-half of a guide wavelength, and should be maintained to reasonable tolerances. Other possible forms of filter obstacles are pins attached to a dielectric board support, "inductive" irises comprising transverse conducting partitions with either circular or rectangular apertures.

It is important to note that, if a polarization-insensitive lens is desired, filter symmetry is required. The ability to achieve polarization-insensitivity is an important aspect of the invention.

These filters are designed to have equivalent phase and delay performance to the section of dielectric filled waveguide that they replace according to microwave filter design theory. Since independent phase and delay is achievable (as explained hereinabove with reference to FIG. 10B), the physical length (or thickness) is not a constraint. However, the more lens thickness deviates from the constant delay surface of the uniform waveguide lens, the more complicated the filter circuits become.

As a specific design example the following TABLE II shows the required number of sections (the number of obstacles or irises required is N+1), bandwidth, and filter synchronous frequency $f_o$ as a function of radial position (for one cross-section plane) for a sample uniform thickness lens with a band-center of 8150 MHz.

TABLE II

| RADIUS (Inches) | N SECTIONS | FILTER BANDWIDTH (MHz) | FILTER $F_o$ (MHz) |
|---|---|---|---|
| 0. | 4 | 1559. | 7662. |
| 0.91 | 4 | 1561. | 7674. |
| 1.83 | 4 | 1569. | 7710. |
| 2.74 | 4 | 1581. | 7770. |
| 3.66 | 4 | 1598. | 7857. |
| 4.57 | 4 | 1622. | 7971. |
| 5.49 | 4 | 1651. | 8115. |
| 6.40 | 3 | 1083. | 7763. |
| 7.32 | 3 | 1111. | 7965. |
| 8.23 | 3 | 1145. | 8208. |
| 9.15 | 3 | 1185. | 8498. |
| 10.06 | 5 | 2694. | 7639. |
| 10.98 | 5 | 2821. | 7999. |
| 11.89 | 4 | 2122. | 7767. |

TABLE II-continued

| RADIUS (Inches) | N SECTIONS | FILTER BANDWIDTH (MHz) | FILTER $F_o$ (MHz) |
|---|---|---|---|
| 12.81 | 4 | 2255. | 8253. |
| 13.72 | 3 | 1552. | 8094. |
| 14.64 | 5 | 3678. | 7133. |
| 15.55 | 5 | 4046. | 7847. |
| 16.47 | 4 | 3234. | 7772. |
| 17.38 | 3 | 2379. | 7747. |
| 18.30 | 2 | 1286. | 7799. |
| 19.21 | 1 | 1092. | 7986. |
| 20.13 | 4 | 7369. | 8458. |
| 21.04 | 3 | 7496. | 9739. |
| 21.96 | 1 | 6122. | 6305. |

In an optimum design, the characteristics of these filters would not be of a standard type since each filter would be operated over only a portion of its total bandwidth. Thus, it would be most efficient to match only this portion of the band. Also it might be desirable to have filters that do not possess the typical end-to-end symmetry in order to improve the transition between guides as the number of filter sections changes from N to N+1. Furthermore, the most sophisticated design would incorporate the impedance mismatch at the guide-to-free-space transitions into the filter design in order to achieve phase, group, and impedance matching simultaneously.

However, in order to make a preliminary estimate of the required filter parameters, a conventional 0.1 db equal ripple response has been assumed. It has also been assumed that the total bandwidth of each filter must be at least ten percent and that the operating point lies sufficiently close to the center of the response to avoid band-edge distortions. The physical length of each section of a waveguide filter as described in TABLE II is between one-quarter guide wavelength for wideband filters and one-half for narrow ones. Thus, a lens thickness of somewhat less than two and one-half wavelengths or five inches is probably adequate to house these filters (for this example).

While "variable cut-off" and "broadband filter" approaches are separately described hereinabove, various hybrids are also possible. For example, in the FIG. 7 lens the cut-off frequency of some of the guides is varied in order to obtain a smooth outer surface. Periodic loading of these guides is an alternative. In this case relatively few obstacles (in only a portion of the guides) might well be adequate since the smooth length variations have already accomplished much of the required phase/group matching.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention. In particular embodiments of any of the lenses described, it is expected that a computer optimization program will be used to minimize the amount of dielectric filling, number of filter elements, and so forth. The resulting configuration would deviate somewhat from the predictions of the design equations.

What is claimed is:

1. A waveguide lens comprising an array of individual waveguide elements arranged in proximate juxtaposition parallel to a central lens axis and extending between inner and outer lens surface contours, the outer boundary of said array defining a rim of said lens, an annular region of said array disposed between a predetermined lens radius and said lens rim having an outer surface contour which follows a constant group delay surface contour, selected ones of said individual waveguide elements in said annular region being modified to provide desired cut-off frequencies individually chosen so as to compensate the phase lengths of said selected waveguide elements, said modification of said waveguide elements providing substantially constant phase delay in said annular region, each of said waveguide elements having cross-sectional symmetry throughout its full length to provide polarization insensitivity.

2. A waveguide lens according to claim 1, wherein said inner lens surface contour is a spherical section.

3. A waveguide lens according to claim 1, wherein each of said individual waveguide elements is substantially square in cross section throughout the length thereof, said modified waveguide elements having rounded corners to compensate their phase lengths.

4. A waveguide lens according to claim 1, wherein chosen ones of said modified waveguide elements contain fillings of dielectric material determining various cut-off frequencies and thus phase lengths.

5. A waveguide lens according to claim 3, wherein chosen ones of said modified waveguide elements also contain fillings of dielectric material.

6. A waveguide lens according to claim 1, wherein said predetermined lens radius equals 0.6 times the lens radius at said rim.

7. A waveguide lens according to claim 6, wherein said outer lens surface contour of the central region of said lens between said predetermined lens radius and said central lens axis follows a constant phase delay surface contour.

8. A waveguide lens according to claim 1, wherein said individual waveguide elements are substantially square in cross section throughout their length, each side wall of said modified waveguide elements including an internal ridge centrally disposed along the full length of said wall, said ridges being configured to provide said desired cut-off frequencies.

9. A waveguide lens according to claim 4, wherein said fillings comprise a dielectric foam, and each of said fillings further including metallic whiskers suspended in said foam.

10. A waveguide lens according to claim 7, wherein said waveguide elements in said central region of said array are free of any modification.

11. A waveguide lens according to claim 4, wherein some of said chosen waveguide elements contain fillings of dielectric material over a fraction of their total length.

12. A waveguide lens according to claim 1, wherein the length of each of said selected waveguide elements is independent of the modification of said element.

13. A waveguide lens comprising an array of individual waveguide elements arranged in proximate juxtaposition parallel to a central lens axis and extending between inner and outer lens surface contours, the outer boundary of said array defining a rim of said lens, an annular region of said array disposed between a predetermined lens radius and said lens rim having an outer surface contour which follows a constant group delay surface contour, selected ones of said individual waveguide elements in said annular region including metallic whiskers mutually spaced within said selected waveguide elements so as to achieve both minimum group delay distortion and minimum phase delay distortion.

14. A waveguide lens according to claim 13, wherein said metallic whiskers are symmetrically disposed within each of said selected waveguide elements.

15. A waveguide lens according to claim 14, wherein said metallic whiskers are suspended from each of the sidewalls of said selected waveguide elements.

16. A waveguide lens according to claim 14, wherein said metallic whiskers in said selected waveguide elements are suspended in dielectric foam.

17. A waveguide lens according to claim 16, wherein said metallic whiskers take the form of plusses.

18. A waveguide lens comprising an array of individual waveguide elements arranged in proximate juxtaposition parallel to a central lens axis and extending between inner and outer lens surface contours, the outer boundary of said array defining a rim of said lens, an annular region of said array being disposed between said rim and a predetermined lens radius of 0.6 times the lens radius at said rim, said outer surface contour in said annular region following a continuous constant group delay surface contour, selected ones of said individual waveguide elements in said annular region containing fillings of dielectric material, the waveguide elements in said annular region being adapted to provide substantially constant phase delay for all polarizations of electromagnetic radiation passing through said annular region, a central region of said array disposed between said central axis and said predetermined lens radius, said central region having an outer lens surface contour which follows a constant phase delay surface contour, said individual waveguide elements in said central region being free of said dielectric material.

* * * * *